US006673232B2

(12) United States Patent
Lindstrom

(10) Patent No.: US 6,673,232 B2
(45) Date of Patent: Jan. 6, 2004

(54) COMPOSITIONS FOR MITIGATING COKE FORMATION IN THERMAL CRACKING FURNACES

(75) Inventor: Michael J. Lindstrom, Downingtown, PA (US)

(73) Assignee: Atofina Chemicals, Inc., Philadelphia, PA (US)

( * ) Notice: Subject to any disclaimer, the term of this patent is extended or adjusted under 35 U.S.C. 154(b) by 102 days.

(21) Appl. No.: 09/882,552

(22) Filed: Jun. 15, 2001

(65) Prior Publication Data

US 2002/0029514 A1 Mar. 14, 2002

Related U.S. Application Data

(60) Provisional application No. 60/221,304, filed on Jul. 28, 2000.

(51) Int. Cl.[7] ..... C10G 9/16; C10G 75/04

(52) U.S. Cl. ..... 208/48 R

(58) Field of Search ..... 208/48 R, 48 AA, 208/131; 585/648, 650, 4

(56) References Cited

U.S. PATENT DOCUMENTS 4,440,625 A * 4/1984 Go et al. ..... 208/48 AA
4,840,720 A * 6/1989 Reid ..... 208/48 AA
5,221,498 A * 6/1993 Reid et al. ..... 252/403
5,463,159 A * 10/1995 Callejas et al. ..... 585/648
5,733,438 A * 3/1998 Tong et al. ..... 208/48 R
5,849,176 A * 12/1998 Zimmermann et al. ... 208/48 R

* cited by examiner

*Primary Examiner*—Bekir L. Yildirim
(74) *Attorney, Agent, or Firm*—Gilbert W. Rudman

(57) ABSTRACT

The invention relates to a combination of compounds and a process using such combination useful for reducing or preventing coke formation in thermal cracking furnaces such as ethylene steam crackers. The combination is comprised of one or more compound of the formula R—$S_x$—R' and one or more compound selected from the following group:

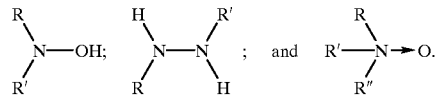

; and

.

10 Claims, No Drawings

COMPOSITIONS FOR MITIGATING COKE FORMATION IN THERMAL CRACKING FURNACES

REFERENCE TO RELATED APPLICATION

This application claims the benefit of U.S. Provisional Application Serial No. 60/221,304 filed Jul. 28, 2000.

BACKGROUND OF THE INVENTION

1. Field of the Invention

This invention relates to compositions or combinations of compounds that mitigate coke formation in thermal cracking furnaces.

2. Description of the Prior Art

In the production of olefins, ethylene in particular, a typical hydrocarbon stream like ethane, propane, butane, naphtha and gas oil, is pyrolyzed at high temperatures in a thermal furnace. The product is a mixture of olefins which are separated downstream. In the production of ethylene, typically water is co-injected with the hydrocarbon feed to act as a heat transfer medium and as a promoter of coke gasification. Typically, a minor but technologically important byproduct of hydrocarbon steam cracking is coke. Steam from the water coinjected reacts with the coke to convert it partially to carbon monoxide and hydrogen. Because of the accumulative nature, coke deposits build up on the reactor walls thus increasing both the tube temperatures and the pressure drop across the tube. This requires shutting down the process for decoking. This periodic shutdown results in an estimated $2 billion in ethylene production per year. In addition there is a direct relationship between the amount of coking and the yield of the olefin, indicating that the coke is formed at the expense of product olefin.

It is common practice in commercial ethylene production to coinject along with the hydrocarbons, small amounts of sulfur containing compounds such as hydrogen sulfide ($H_2S$), dimethyl sulfide (DMS) or dimethyl disulfide (DMDS) to minimize coke formation. It has been proposed that the sulfur passivates the active metal surface known to be a catalyst for coke formation. In addition, the sulfur compounds are known to reduce the formation of carbon monoxide (CO), formed by the reaction of hydrocarbons or coke with steam, again by passivating the catalytic action of the metal surface and by catalyzing the water gas shift reaction which converts the CO to carbon dioxide ($CO_2$). Minimizing the amount of CO formed is essential for the proper functioning of downstream reduction operations.

U.S. Pat. No. 4,404,087 discloses that pretreating cracking tubes with compositions containing tin (Sn) compounds, antimony (Sb) and germanium (Ge) reduces the rate of coke formation, during the thermal cracking of hydrocarbons.

Combinations of Sn, Sb and Si are disclosed to do the same in U.S. Pat. No. 4,692,234.

Mixtures of chromium and antimony compounds of 2-ethyl hexanoic acid and Cr—Sn compositions have also been claimed to reduce coke formation, as measured by a time weighted CO selectivity index (EP 134555, 1985).

Several phosphorous and sulfur compound combinations are disclosed (WO 9914290, 1999) with Sn and Sb compounds (U.S. Pat. No. 4,551,227 and EP 733693, 1996), for decreasing the coke formed in hydrocarbon pyrolysis furnaces.

In general, U.S. Pat. Nos. 4,507,196; 4,511,405; 4,552,643; 4,613,372; 4,666,583; 4,686,201; 4,687,567; 4,804,487; and 5,015,358, teach that the metals Sn, Ti, Sb, Ga, Ge, Si, In, Al, Cu, P, and Cr, their inorganic and organic derivatives, individually or as mixtures will function as antifoulants for the reduction of coke during hydrocarbon pyrolysis.

Phosphoric acid and phosphorous acid mono and di-esters or their amine salts, when mixed with the feed to be cracked, for example, ethane, showed a significant increase in run lengths compared to an operation performed without the additives (U.S. Pat. No. 4,105,540).

Pretreating furnace tubes at high temperature with aromatic compounds such as substituted benzenes, naphthalenes and phenanthrenes, prior to introduction of the cracking feed has been shown to reduce catalytic coke formation (U.S. Pat. No. 5,733,438). Cracking a heavy hydrocarbon, preferably a higher olefin stream prior to bringing on the lower hydrocarbons, has been shown to reduce coking (U.S. Pat. No. 4,599,480). In both cases, a thin layer of catalytically inactive coke formed on the tube surface is claimed to inhibit the propagation of coke formation.

Several patents disclose the use of various Si compounds to lay down a ceramic layer on metal tubes and thus reduce the coke formed in pyrolysis. Compounds such as siloxanes, silanes and silazanes have been used to deposit a silica layer on the metal alloy tubes (U.S. Pat. Nos. 5,424,095; 5,413,813; 5,208,069). Silicates have been independently claimed to do the same in patents NL. 7804585; GB 1552284 and DE 281 9219. In almost all of the examples the coke minimization is of catalytic coke, formed mainly during the early stages of pyrolysis. A patent (WO 9522588), teaches the use of a silicon compound and a sulfur compound as a mixture that contains Si/S ratio of 1/1 to 5/1 to mitigate coke formation.

Another approach to reduce coking is to passivate the active metal surface of pyrolysis tubes by forming a surface alloy, comprising of metals/oxides of metals that are known to not catalyze coke formation. High Temperature Alloys (HTA) are a group of austenitic stainless steels used in industrial processes operating at elevated temperatures above 650° C. These typically contain 18–38% Cr, 18–48% Ni, with the balance being Fe and alloying additives. Iron and Nickel are known catalysts for the formation of filamentous carbon during ethylene production and hydrocarbon pyrolysis in general. An oxide layer of Chromium or Aluminum on the other hand are known to be inhibitors of catalytic coke formation and thus are used to protect these alloys. Protection using these oxides have to be carefully engineered so that physical characteristics and properties of the HTA, such as creep resistance, are not compromised and the oxide layer is stable to harsh conditions typically encountered in hydrocarbon pyrolysis. CoatAlloy® is a technology developed by Surface Engineered Products of Alberta, Canada, that provides a process to surface alloy the inside of a HTA tube for use in an ethylene furnace. Cr—Ti—Si and Al—Ti—Si formulated products are coated on a base alloy surface and heat treated to form either a diffusion protective layer only or a diffusion layer and a enrichment pool layer next to it. In both cases, oxidizing gases are passed to activate the layers by formation of alumina and or chromia along with titania and silica. The treated tubes have been claimed to significantly reduce catalytic coke formation, minimize carburization of the base alloy tubes, exhibit improved erosion resistance and thermal shock resistance (WO 9741275, 1997). The ethane gas stream used to test the effectiveness of the coating contained 25–30 PPM of sulfur.

Reduction of coking rates on both quartz and Incoloy surfaces by the use of low concentrations of hexachloroplatinic acid ($H_2PtCl_6$) in the steam used for ethane cracking, have been reported (Industrial & Engineering Chemistry Research, Vol:37, 3, 901, 1998). Coke formation rates were reduced although the apparent activation energies increased. The reduced effectiveness of the additive at higher temperatures suggests that the primary impact of the additive was on the surface coke formation process.

These previous approaches have involved either metal passivation techniques with various additives like sulfur, silicon, phosphorous, etc., or the use of special alloys which reduce coking. All these are surface treatments.

The objective of this invention was to develop improved technology for reducing the formation of coke in commercial thermal cracking furnaces. Reduced coke levels will translate into higher ethylene yields and the reduced downtime for decoking of the unit will also allow higher production rates.

SUMMARY OF INVENTION

The invention is a combination useful for reducing or preventing coke formation in thermal cracking furnaces such as ethylene steam crackers, the combination is comprised of (A) one or more compound of the formula $$R—S_x—R'$$

wherein R & R' are independently H, alkyl with 1 to 24 carbons straight chain or branched, aryl and x=1 to 5; and (B) one or more compound selected from the following group:

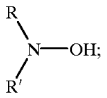

wherein R and R' are independently H, alkyl with 1 to 24 carbons straight chain or branched, aryl (e.g., hydroxylamines);

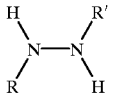

wherein R and R' are independently H, alkyl with 1 to 24 carbons straight chain or branched, aryl; (e.g., alkyl hydrazines); and

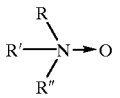

wherein R is H, alkyl and R' & R" are alkyl of 1 to 24 carbon atoms (e.g., alkyl/aryl amine oxides).

The invention is also an improved process for producing olefinic materials like ethylene or propylene by the introduction of the above mixture to the hydrocarbon feed stream to be cracked or to another feed stream such as water/steam prior to either of the streams entering the thermal cracking furnace.

DETAILED DESCRIPTION OF THE INVENTION

There are two basic mechanisms for the formation of coke in ethylene furnaces, catalytic, and non-catalytic. In catalytic coke formation, hydrocarbon is adsorbed on a metal site. As the metal catalyzes the decomposition of the hydrocarbon to elemental carbon, the carbon diffuses through the metal particle. Precipitation of the carbon vapor occurs beneath the surface and the metal particle is actually lifted off from the surface. This process of carbon diffusion and precipitation occurs over-and-over with the result that filaments (each tipped with a metal particle) of carbon are formed on the inside surface of the cracking tubes. Sulfur and phosphorous derivatives have been used to reduce the amount of catalytic coke formation presumably by passivating the metal surface to reduce or eliminate the phenomena that results in the formation of the carbon filaments.

In non-catalytic coke formation, hydrocarbons decompose in the gas phase thermally via free-radical reactions. Many of these reactions result in the formation of useful compounds like ethylene, propylene, etc. However, various recombination reactions can result in the formation of longer-chain species that can be trapped in the surface carbon filaments. As time goes on, these coke precursors grow and become full-fledged coke. Other long-chain species can exit the reactor and condense in the cooling section. The end result of these non-catalytic reactions is the formation of additional coke and/or heavy condensates, both of which act to reduce ethylene.

Previous art has addressed preventing only the formation of catalytic coke by passivation of the metal surface. The present invention addresses both the formation of catalytic and non-catalytic coke. This approach will lead to lower levels of total coke formation than those previously described and will result in decreased downtime for the commercial units.

In the broadest sense, this invention combines surface treatment to passivate the metal to reduce catalytic coke formation and reduction of gas-phase coke formation. Thus, any compound known to passivate metal surfaces in conjunction with compounds known to scavenge free radicals like phenol derivatives, mercaptans, hydrazines, phosphines, etc., are within the scope of this invention. Single compounds which include both functions mentioned above like a sulfur-containing hydroxylamine derivative should also be included.

The invention is also an improved process for producing olefinic materials like ethylene or propylene by the introduction of the above components to the hydrocarbon feed stream to be cracked or to another feed stream such as water/steam prior to either of the streams entering the thermal cracking furnace.

The sulfur-containing compounds useful in the present invention have the formula $$R—S_x—R'$$

wherein R & R' are independently H, alkyl with 1 to 24 carbons straight chain or branched, aryl and x=1 to 5.

Examples of such compounds include $H_2S$, methyl-, ethyl-, propyl-, butyl- and higher mercaptans, aryl mercaptans, dimethyl sulfide, diethyl sulfide, unsymmetrical sulfides such as methylethyl sulfide, dimethyl disulfide, diethyl disulfide, methylethyl disulfide, higher disulfides, mixtures of disulfides like merox, sulfur compounds naturally occuring in hydrocarbon streams such as thiophene, alkylthiophenes, benzothiophene, dibenzothiophene, polysulfides such as t-nonyl polysulfide, t-butyl polysulfide, phenols and phosphines. Preferred are alkyl disulfides such as dimethyldisulfide and most preferred is dimethyl sulfide. Preferred ranges of material are from 5 ppm relative to the hydrocarbon feed stream to 1000 ppm. More preferred is 25–500 ppm, and most preferred is 100–300 ppm. Ratios of the sulfur-containing material to the free-radical-scavenging component range from 1–0.1 (weight-to-weight) to 1–100.

Component B compounds are selected from the group having the following formulas:

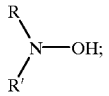

wherein R and R' are independently H, alkyl with 1 to 24 carbons straight chain or branched, aryl (e.g., hydroxylamines);

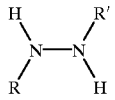

wherein R and R' are independently H, alkyl with 1 to 24 carbons straight chain or branched, aryl (e.g., alkyl hydrazines); and

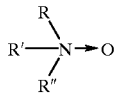

wherein R is H, alkyl and R' & R" are alkyl of 1 to 24 carbon atoms (e.g., alkyl/aryl amine oxides).

Examples of such compounds include hydroxylamine, monoisopropylhydroxylamine, diethylhydroxylamine, dibutylhydroxylamine, hydrazine, methylhydrazine, dimethylhydrazine, triethylamineoxide. Preferred is hydrazine, more preferred is hydroxylamine, and the most preferred is diethylhydroxylamine. Preferred ranges of material are from 5 ppm relative to the hydrocarbon feed stream to 1000 ppm. More preferred is 25–500 ppm, and most preferred is 100–300 ppm. Ratios of the material to the sulfur-containing component range from 1–0.1 (weight-to-weight) to 1–100.

This combination is useful for reducing or preventing coke formation in thermal cracking furnaces such as ethylene steam crackers.

Also, the use of the combinations described above with various surface treatments, pretreatments, special alloys, and special tube coatings described in the prior art is within the scope of this invention.

The present invention discloses a synergy between sulfur chemicals like DMS or DMDS (which passivate the metal surface) and free-radical scavengers, like DEHA, which inhibit coke formation in the gas phase by scavenging newly forming coke precursors. Independent of the mechanism, the synergy exhibited between the abovementioned compounds which results in lower levels of total coke formation than either of the components used alone is surprising and unexpected.

A preferred method to practice this invention is to co-inject either separately or together a mixture of DMS or DMDS, and DEHA into the hydrocarbon feed stream just prior to its introduction to the furnace. Optimal treat levels will depend on the operational variables of individual commercial furnaces, but levels between 5 ppm and 1000 ppm of each component should cover the majority of commercial situations.

An advantage of the present invention is that the treat levels of each component can be tailored and optimized for each commercial unit depending on its operational variables.

In theory, it is desirable that minimal decomposition of the disclosed materials occurs prior to its introduction to the cracking tubes of the furnace. Thus, the method of injection into the furnace is likely to have a major impact on this. Systems which allow rapid injection with little preheating should give better results.

This invention could also have utility in conjunction with the development of new alloys or tube coatings being developed to reduce or eliminate the formation of catalytic coke.

Many hydrocarbon feed streams contain naturally occurring sulfur compounds like thiophenes, benzothiophenes, dibenzothiophenes, sulfides, and disulfides. The use of the naturally occurring sulfur compounds with the abovementioned free-radical scavengers is within the scope of this invention.

The following Example is offered to illustrate this invention and the modes of carrying out this invention.

EXAMPLE 1

Dimethyl sulfide (DMS), dimethyl disulfide (DMDS), and anhydrous diethylhydroxylamine (DEHA) were purchased from Aldrich Chemical Company. Research-grade iron-nickel powders were obtained from Johnson Matthey Inc.

Powdered Fe—Ni was placed in the bottom of a ceramic boat in the center of the quartz reactor (40 mm I.D. and 90 cm long) which was jacketed by a conventional Lindberg horizontal furnace. The metal powder was then reduced in a 10% $H_2$—He mixture at 600° C. for 1 hour, then the reactor was purged with helium as the reactor system was brought to the desired temperature. The gas flow to the reactor was monitored and regulated with MKS mass flow controllers. After the desired temperature was reached, the reactant mixture containing ethane/steam (4:1) was introduced by the use of mass flow controllers and the DEHA/sulfur species mixtures were introduced using a SAGE syringe pump. The reactions were typically carried out for two hours over which time the exit gas compositions were analyzed by gas chromatography. After the reaction period, the reactor was again purged with helium as it cooled to room temperature.

The amount of catalytic carbon formed during each run was determined by careful weighing of the ceramic boat which contained the metal powder and the formed catalytic carbon. The remaining tars on the reactor wall and in the trap were defined as pyrolytic carbon and were also carefully weighed. The total carbon is defined as the sum of the catalytic and pyrolytic carbon.

For the results tabulated below, the following conditions were used:

| | |
|---|---|
| Ethane flow rate: | 140 cc/min. |
| Steam Flow rate: | 35 cc/min. |
| Pressure: | 1 atm |
| Reaction time: | 2 hours |
| Temperature: | 815° C. |
| Fe—Ni alloy: | 20:80 |

The numbers for Catalytic carbon, total carbon, and ethylene represent yields based on total carbon balance.

TABLE 1

Effect of DMS and DEHA on Carbon Formation and Ethylene Yield

| Temp. (° C.) | DMS (ppm) | DEHA (ppm) | Catalytic Carbon | Total Carbon | Ethylene |
|---|---|---|---|---|---|
| 815 | 0 | 0 | 10.2 | 59.3 | 8.7 |
| 815 | 150 | 0 | 4.3 | 31.3 | 23.2 |
| 815 | 300 | 0 | 3.1 | 34.1 | 17.6 |
| 815 | 0 | 150 | 21.5 | 46.5 | 17.4 |
| 815 | 0 | 300 | 14.7 | 35.9 | 17.0 |
| 815 | 150 | 150 | 6.22 | 19.3 | 20.6 |

TABLE 2

Effect of DMDS and DEHA on Carbon Formation and Ethylene Yield

| Temp. (° C.) | DMDS (ppm) | DEHA (ppm) | Catalytic Carbon | Total Carbon | Ethylene |
|---|---|---|---|---|---|
| 815 | 0 | 0 | 10.2 | 59.3 | 8.7 |
| 815 | 25 | 0 | 4.1 | 62.7 | 14.9 |
| 815 | 0 | 300 | 14.7 | 35.9 | 17.0 |
| 815 | 25 | 300 | 18.9 | 29.1 | 28.6 |

Throughout the specification, the inventors refer to various materials used in their invention as based on certain components, and intend that they contain substantially these components, or that these components comprise at least the base components these materials.

It will be apparent to those skilled in the art that various modifications and variations can be made to the composition and process of the invention without departing from the spirit or scope of the invention. It is intended that these modifications and variations of this invention are to be included as part of the invention, provided they come within the scope of the appended claims and their equivalents.

What is claimed is:

1. A combination useful for reducing or preventing coke formation in thermal cracking furnaces, the combination being comprised of (A) one or more compound of the formula $$R—S_x—R'$$

wherein R & R' are independently H, alkyl with 1 to 24 carbons straight chain or branched, aryl and x=1 to 5; and (B) one or more compound selected from the following group:

B1—a hydroxylamine of the formula:

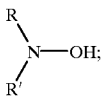

wherein R and R' are independently H, alkyl with 1 to 24 carbons straight chain or branched, aryl;

B2—an alkyl hydrazine of the formula:

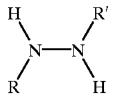

wherein R and R' are independently H, alkyl with 1 to 24 carbons straight chain or branched, aryl; and P3—an amine oxide of the formula

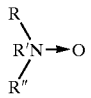

wherein R is H, alkyl and R' & R" are alkyl of 1 to 24 carbon atoms.

2. An improved process for producing olefinic materials by the introduction of the combination of claim 1 to a hydrocarbon feed stream to be cracked or to another feed stream prior to either of the streams entering the thermal cracking furnace.

3. The blend of claim 1 wherein the compound of A is H2S, methylmercaptan, ethylmercaptan, propylmercaptan, butymercaptan, an aryl mercaptan, dimethyl sulfide, diethyl sulfide, methylethyl sulfide, dimethyl disulfide, diethyl disulfide, methylethyl disulfide, thiophene, an alkylthiophenes, benzothiophene, dibenzothiophene, or a polysulfide.

4. The blend of claim 1 wherein the compound of A is an alkyl disulfide.

5. The blend of claim 4 the alkyl disulfide is dimethyldisulfide or dimethyl sulfide.

6. The blend of claim 1 wherein the compound of Dl is hydroxylamine, monoisopropylhydroxylamine, diethylhydroxylamine, dibutylhydroxylamine; the compound of B2 is hydrazine, methylhydrazine, dimethylhydrazine; and the compound of B3 is triethylamineoxide.

7. The blend of claim 6, wherein B is an hydrazine or a hydroxylamine.

8. The blend of claim 7 wherein the hydroxyamine is diethylhydroxylamine.

9. The blend of claim 1 wherein the concentration of A relative to the hydrocarbon feed stream is from 5 ppm to 1000 ppm, he concentration of B relative to the hydrocarbon feed stream to is from 5 ppm 1000 ppm and the ratios of the A to B components ranges from 1–0.1 (weight-to-weight) to 1–100.

10. A combination useful for reducing or preventing coke formation in thermal cracking furnaces, the combination being comprised of (A) at least one of dimethyldisulfide and dimethyl sulfide; and (B) diethylhydroxylamine;

wherein both component A and B are present at a concentration relative to the hydrocarbon feed stream of 100–300 ppm and at a ratio to each other ranging from 1–0.1 (weight-to-weight) to 1–100.

* * * * *